US007509903B2

(12) United States Patent
Facciano et al.

(10) Patent No.: US 7,509,903 B2
(45) Date of Patent: Mar. 31, 2009

(54) SEPARABLE STRUCTURE MATERIAL

(75) Inventors: Andrew B. Facciano, Oro Valley, AZ (US); Robert T. Moore, Tucson, AZ (US); Gregg J. Hlavacek, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/190,297

(22) Filed: Jul. 27, 2005

(65) Prior Publication Data

US 2008/0163748 A1 Jul. 10, 2008

Related U.S. Application Data

(60) Provisional application No. 60/669,695, filed on Apr. 8, 2005.

(51) Int. Cl.
*B64G 1/64* (2006.01)

(52) U.S. Cl. ..... 89/1.14; 89/36.01; 89/36.02; 89/36.17; 107/377; 107/378; 428/43; 109/36

(58) Field of Classification Search ..... 102/377, 102/378; 89/1.14, 36.01, 36.02, 36.17; 109/36; 428/43

See application file for complete search history.

(56) References Cited

U.S. PATENT DOCUMENTS 4,080,902 A * 3/1978 Goddard et al. ..... 102/200
4,648,227 A * 3/1987 Reusch ..... 52/419
4,649,824 A * 3/1987 Guay ..... 102/307
5,170,004 A 12/1992 Garrison
5,372,071 A 12/1994 Richards et al.
5,483,894 A 1/1996 Facciano et al.
5,806,791 A 9/1998 Hatalsky et al.
5,992,328 A * 11/1999 Blain et al. ..... 102/378
5,993,929 A 11/1999 Bizer et al.
6,021,703 A * 2/2000 Geiss et al. ..... 89/36.17
6,148,729 A 11/2000 Smith et al.
6,298,786 B1 * 10/2001 Grosskrueger et al. ..... 102/378
6,336,611 B1 * 1/2002 Collinucci ..... 244/129.4
6,343,954 B1 2/2002 Facciano et al.
6,386,110 B1 * 5/2002 Landman et al. ..... 102/331
6,422,148 B1 * 7/2002 Xu et al. ..... 102/313
6,548,794 B2 4/2003 Facciano et al.
6,619,181 B1 * 9/2003 Frey et al. ..... 89/36.17
6,925,938 B2 * 8/2005 Baginski et al. ..... 102/202.7
7,261,038 B2 * 8/2007 Cleveland ..... 102/378
7,278,354 B1 * 10/2007 Langan et al. ..... 102/306

(Continued)

*Primary Examiner*—Bret Hayes
*Assistant Examiner*—Benjamin P Lee
(74) *Attorney, Agent, or Firm*—Renner, Otto, Boisselle & Sklar, LLP

(57) ABSTRACT

A separable structure includes composite material that is separated or severed by a reactive pyrotechnic material. According to one embodiment, the structure includes a pair of composite laminate structural portions, each including multiple layers of composite material. The portions each extend into an overlap region, within which the composite layers of the two structural portions may be alternately placed, overlapping one another. A reactive material is also placed within this overlap region, for instance being in layers between pairs of the composite material layers. The reactive material may be ignited to cause destruction of the pyrotechnic material, and a matrix or resin material of the composite materials layers in the overlap region. This causes the structure to sever or separate along a line of separation within the overlap region. The separation may occur without need to sever fibers of the composite material.

22 Claims, 6 Drawing Sheets

U.S. PATENT DOCUMENTS

2002/0069784 A1* 6/2002 Landman et al. ..... 102/331
2002/0092415 A1* 7/2002 Caron ..... 89/36.02
2004/0118273 A1* 6/2004 Zank ..... 89/36.17
2006/0162539 A1* 7/2006 Fucke et al. ..... 89/36.17

* cited by examiner

SEPARABLE STRUCTURE MATERIAL

This application claims priority to U.S. Provisional Patent Application No. 60/669,695, filed Apr. 8, 2005, which is herein incorporated by reference in its entirety.

TECHNICAL FIELD OF THE INVENTION

The invention is in the general field of structural materials that are separable, severable, or destructible.

DESCRIPTION OF THE RELATED ART

Interstage airframes for multistage missiles have been fabricated out of light metals such as aluminum. The aluminum airframes have been severed using pyrotechnic devices, such as linear shape charges. Such aluminum interstages provide a significant weight penalty, such that it would be advantageous to substitute a lighter material, for example a composite material. However, composite materials may have fibers that are difficult to sever, leading to a need to utilize a larger linear shape charge. This reduces the weight advantage of switching to composite materials, and also increases the amount of shock and vibration caused by detonation of the linear shape charge. Other alternatives that have been tried, such as utilizing small regions of severable material within a larger composite structure, lead to an increased need to rely on fasteners to hold the structure together. Increased use of fasteners increases complexity of the system, and reduces the integrity of the structure.

From the foregoing, it will be appreciated that improvements in this technical field may be desirable.

SUMMARY OF THE INVENTION

According to one aspect of the invention, a reactive pyrotechnic material is used to vaporize or otherwise destroy the resin of at least part of a composite material, thereby allowing for separation, severing, or substantial disintegration of the material, even without substantial severing or destruction of fibers of the composite material.

According to another aspect of the invention, a separable structure includes a pair of portions that have plural composite material layers. The composite material layers overlap and may interdigitate in an overlap region. Reactive pyrotechnic material is placed in the overlap region between at least some of the layers. The pyrotechnic material is coupled to an igniter. Ignition of the pyrotechnic material vaporizes, destroys, or damages the integrity of resin in the composite material layers, thereby causing the composite material layers to separate from one another in the overlap region, thus separating the portions of the structure.

According to yet another aspect of the invention, a method of separating a separable structure includes igniting reactive pyrotechnic material that is within the structure, in order to separate composite material layers of the structure from one another.

According to still another aspect of the invention, a composite material has load-carrying fibers and reactive pyrotechnic fibers. The reactive pyrotechnic fibers may be ignited to vaporize or otherwise disturb the integrity of resin material in at least part of the composite material.

According to a further aspect of the invention, a separable laminate structure includes: a composite material in plural composite material layers; a reactive pyrotechnic material placed between layers of the composite material; and an igniter for igniting the reactive laminate material, to thereby separate parts of the laminate structure along a line of separation.

According to a still further aspect of the invention, a separable laminate structure includes: a composite material in plural composite material layers; a reactive pyrotechnic material placed between a pair of the composite material layers; and an igniter for igniting the reactive pyrotechnic material, to thereby separate parts of the laminate structure along a line of separation. The line of separation is in an overlap region in which the composite material layers overlap. The reactive pyrotechnic material is configured to separate the composite material layers in the overlap region by reducing integrity of a matrix material of the composite material without severing fibers of the composite material layers.

According to another aspect of the invention, a method of separating a structure, includes: configuring the structure, such that plural composite material layers of the structure overlap in an overlap region of the structure; such that each of the composite material layers extend beyond the overlap region on a first side or a second side of the overlap region, but not on both sides of the overlap region; and such that a reactive pyrotechnic material of the structure is in the overlap region; and igniting the reactive material to separate the composite material layers that extend into the first side of the overlap region from the composite material layers that extend into the second side of the overlap region.

According to yet another aspect of the invention, a composite structural material includes: a matrix material; reactive pyrotechnic material fibers within the matrix material; and load-carrying fibers within the matrix material. The load-carrying fibers are stronger than the reactive pyrotechnic material fibers.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the accompanying drawings, which are not necessarily to scale.

DETAILED DESCRIPTION

A separable or severable structure includes composite material that is separated or severed by a reactive pyrotechnic material. According to one embodiment, the structure includes a pair of composite laminate structural portions, each including multiple layers of composite material. The portions each extend into an overlap region, within which the composite layers of the two structural portions may be alternately placed, overlapping one another. A reactive material is also placed within this overlap region, for instance being in layers between pairs of the composite material layers of the structural portions. The reactive material may be ignited to cause destruction of the pyrotechnic material, and matrix or resin material of the composite materials layers in the overlap region. This causes the structure to sever or separate along a line of separation within the overlap region. The severing or separation may occur without need to sever any of the fibers of the composite material layers. Thus, a relatively small amount of explosive material may be used to separate a high-strength composite structure. This small amount of explosive results in reduced shock and vibration loads to the structure, compared with the explosive force needed to sever fibers of a composite material. The severable or separable structure may be used in any of a variety of applications that require separation of parts of structures. Examples include separation of stages of missiles, and separation of nose cones of missiles.

Figure 1:
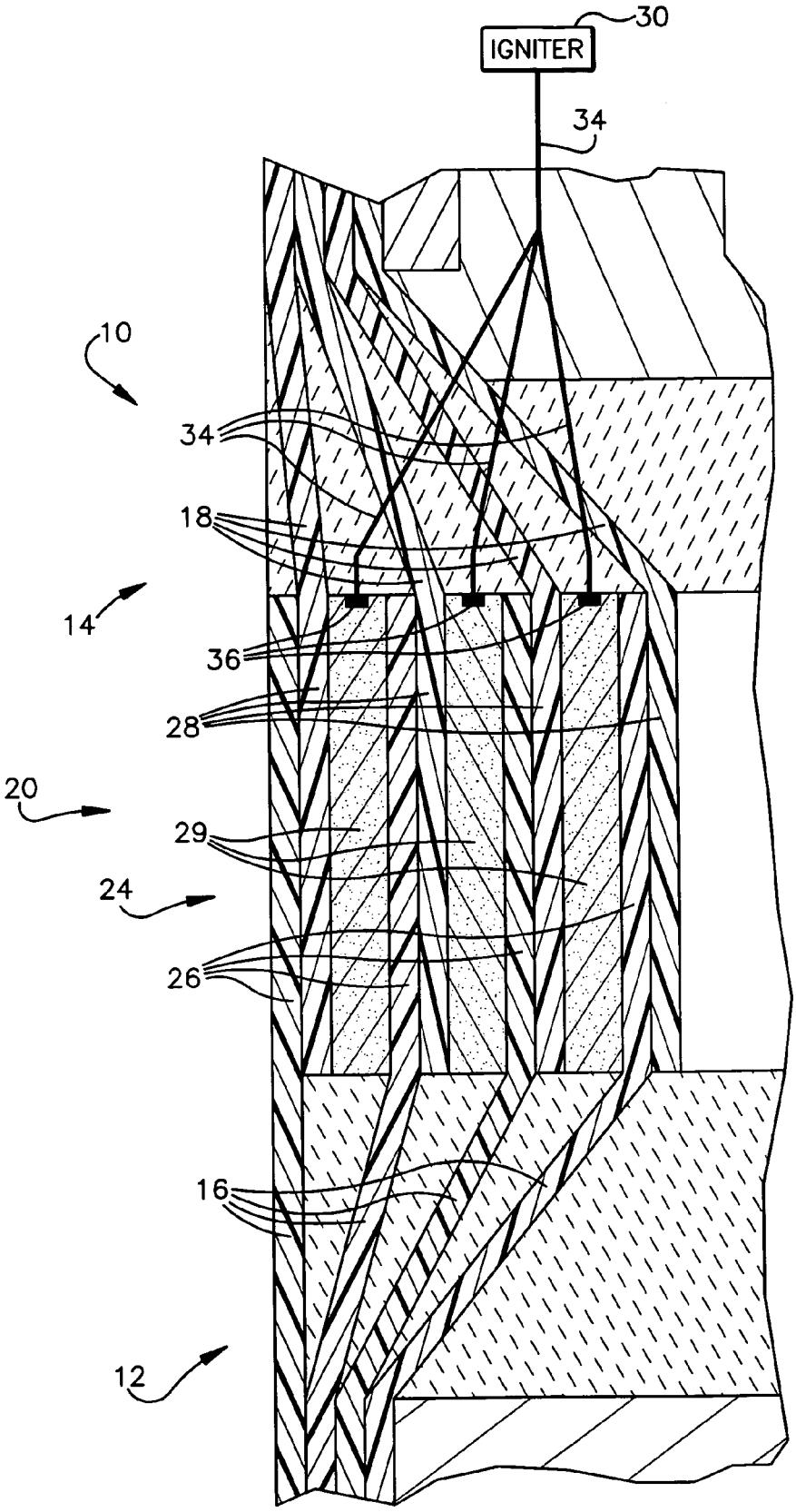
FIG. 1 is a cross-sectional view of a portion of a separable structure in accordance with the present invention.

Referring to FIG. 1, a separable structure 10 includes a first composite material structure portion 12 and a second composite material structure portion 14. Each of the portions 12 and 14 is made up of plural composite material layers, with the first portion 12 including first composite material layers 16, and the second portion 14 including second composite material layers 18. The composite material layers 16 and 18 each include fibers bound together by a matrix or resin. Individual of the first layers 16 and the second layers 18 have respective overlap ends 26 and 28 that overlap and interdigitate in an overlap region 20.

Reactive pyrotechnic material 24 within the overlap region 20 bonds together the composite material layers 16 and 18 within the overlap region 20. The reactive material 24 may include plural discrete reactive material layers or pads 29 placed between adjacent of the composite material layers 16 and 18. The reactive material layers 29 are coupled to an electric igniter 30, by ignition signal lines 34. The ignition signal lines 34 are coupled to ignition devices 36, for example, wire bridges, placed in one or more of the reactive material layers 29. Upon the sending of a suitable signal from the electrical igniter 30, a pyrotechnic reaction is initiated in the reactive material 24.

Figure 2:
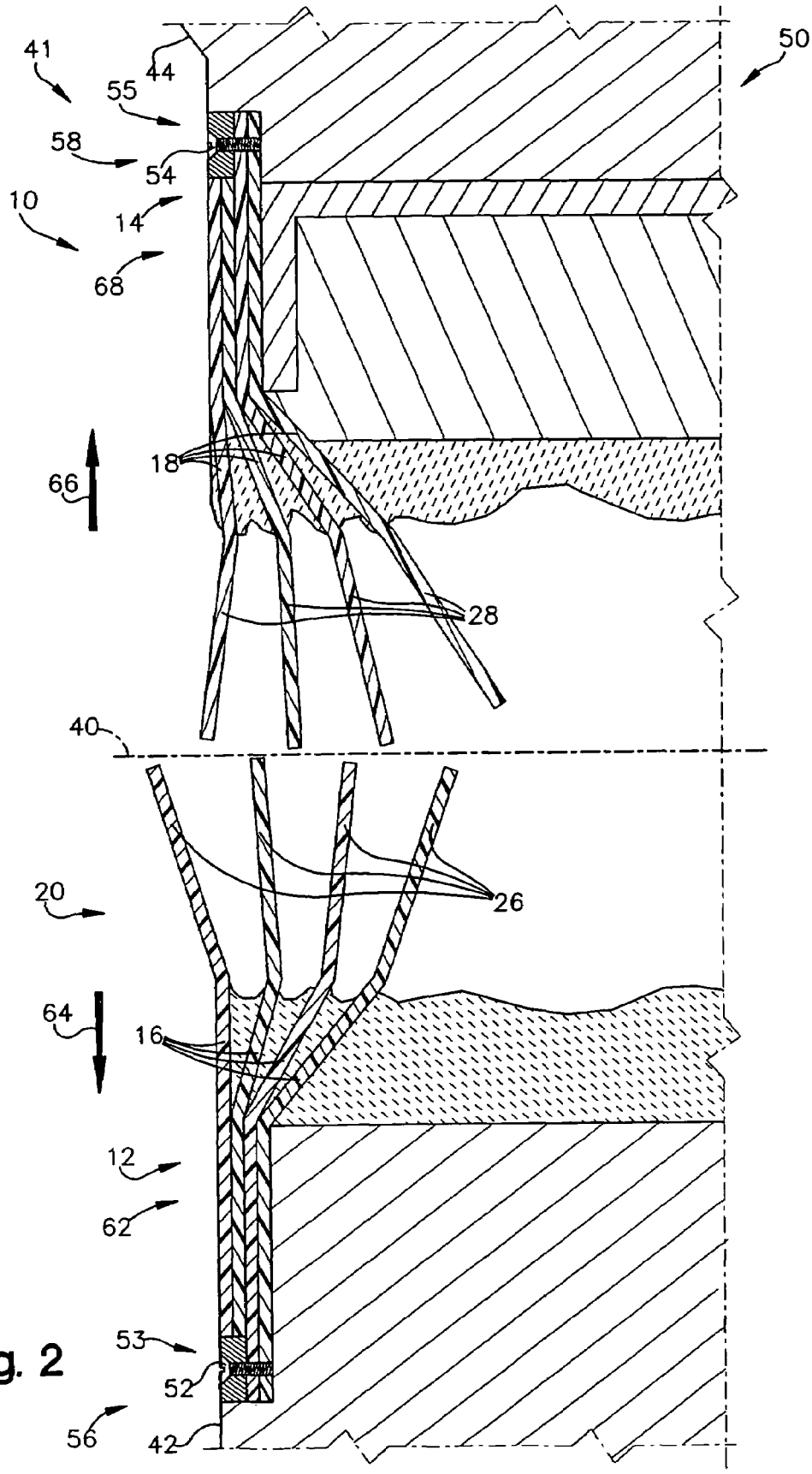
FIG. 2 illustrates detonation and separation of the separable structure of FIG. 1.

When an electric signal, current, or pulse is sent from the electric igniter 30, through the ignition signal lines 34, to the ignition devices 36, ignition occurs within the reactive material 24 of the reactive material layers 29. This pyrotechnic reaction is an explosion that produces heat. The heat produced by the explosion of the reaction material 24 vaporizes a matrix material, such as a resin, within the composite material layers 16 and 18. This breaks the mechanical coupling between the overlapped portions (ends) 26 and 28 of the conductive material layers 16 and 18, in the overlap region 20. The result is separation of the conductive material portions 12 and 14 along a separation line 40 that is within the overlap region 20. This separation is illustrated in FIG. 2. It should be stressed that the separation between the composite material structure portions 12 and 14 occurs because of the destruction of the resin mechanically linking the interdigitated composite material layers 16 and 18 within the overlap region 20. The separation does not occur because of severing of the fibers of the conductive material layers 16 and 18, although it will be appreciated that the reaction of the reactive material 24 may involve some incidental severing of fibers of the composite material layers 16 and 18.

Since separation of the separable structure 10 along the separation line 40 is accomplished by the removal of the resin that provides the integrity of the overlapped parts 26 and 28 of the composite material layers 16 and 18, rather than severing of the fibers of the composite material layers, a smaller amount of pyrotechnic material may be utilized, compared with systems that rely on severing of composite material fibers in order to sever or separate the structure. The reduction of explosive force necessary to separate the separable structure 10 means that a smaller amount of reactive material may be utilized. Also, the shock and vibration forces caused by detonation of the reactive material 24 are smaller, again compared with situations where separation is accomplished by severing fibers of a composite material. It will be appreciated that it may be desirable to have reduced shock and vibration loads in order to prevent possible damage to delicate components that may be mechanically coupled to the separable structure 10, for example, optical equipment that may be located within a missile that includes the separable structure 10.

Further, it will be appreciated that in the structure 10 the force of the reactive material layers 29 advantageously acts both toward the outside of the structure (e.g., toward the outer diameter of a cylindrical structure) as well as inwardly toward the interior of the structure (e.g., toward the inner diameter of a cylindrical structure). This allows efficient use of the energy produced in reaction of the reactive pyrotechnic material 24, as well as removing the need for an inner structure such as a steel blast ring, to provide containment of the explosive force.

Another advantage to the separable structure 10 is that the debris created by the separation may be lesser in amount or in damage potential than that created in separation of a metal or continuous composite structure. Destruction of the matrix or resin may involve vaporization and/or pulverization of material, in contrast to the creation of chunks of heavier metal or composite fiber material that may result from explosive separation of other types of structure.

Figure 3:
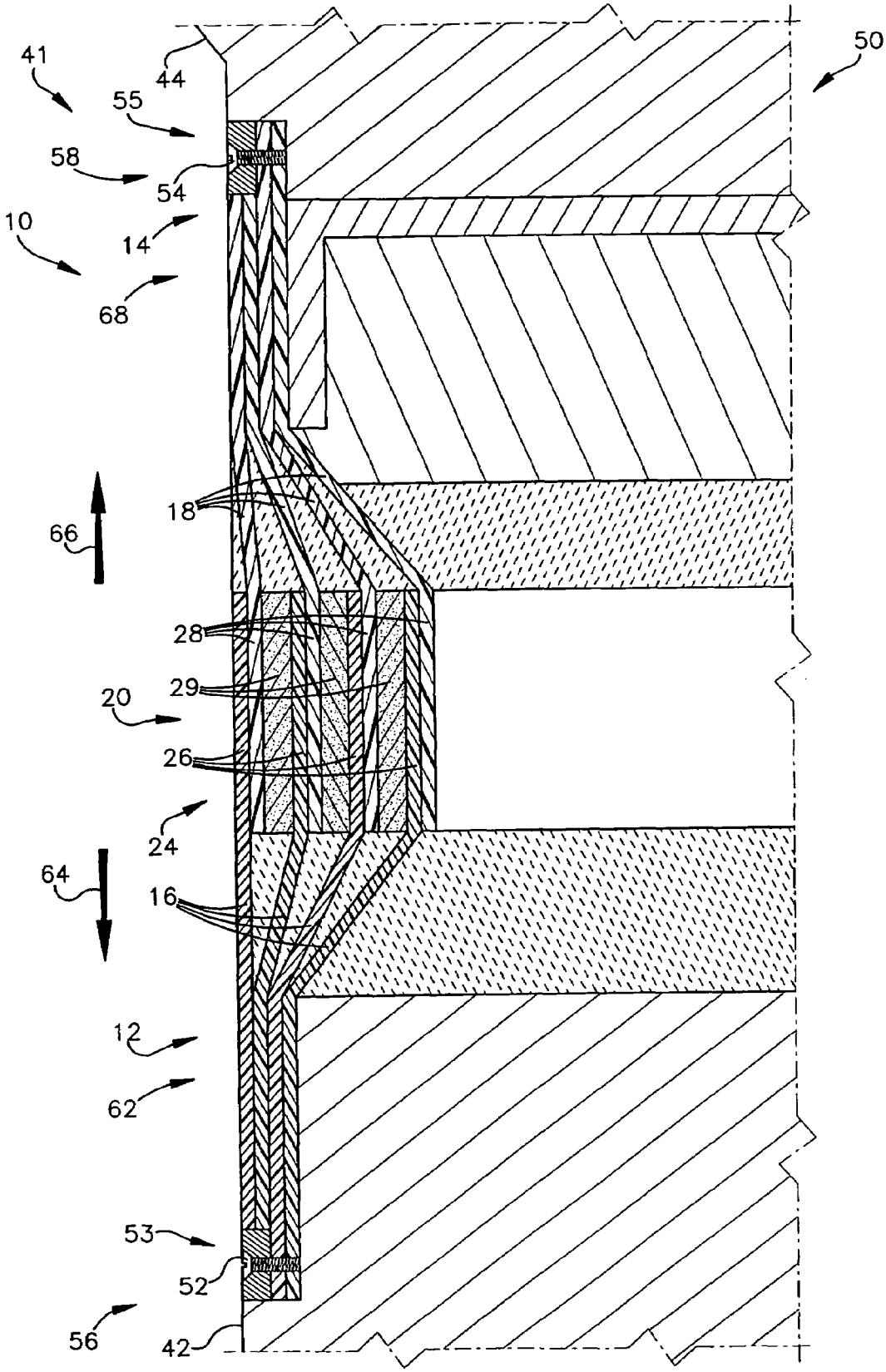
FIG. 3 is a cross-sectional view of the structure of FIG. 1, showing the attachment of the structure to other, non-separable structures.

FIGS. 2 and 3 show the incorporation of the separable structure 10 as part of a stage separation mechanism 41 for separating a pair of stages 42 and 44 of a missile 50. The first composite material structure portion 12 is coupled to the first stage 42 by countersunk screws 52 in first holes 53. The second composite material structure portion 14 is similarly coupled to the second stage 44 by a series of countersunk screws 54 in second holes 55. The separable structure 10 advantageously connects to the stages 42 and 44 without the need for any additional hardware over that used in stronger structures such as a full length composite section or an aluminum inner stage section. The separable structure 10 utilizes less hardware for mounting than interstage sections that include weakened portions for easy separation, or that includes additional structures for mounting explosives such as a mild detonating charge. The separable structure 10 provides a strong, lightweight, yet easily separable structure, capable of being separated with a relatively small amount of explosive and with relatively small shock and vibration. The separable structure 10 also has its reactive pyrotechnic material 24 advantageously integrated into the structure in the overlap region 20. This makes for an efficient use of the energy released by the explosive, while advantageously avoiding the need for additional structural elements to contain the explosive force.

Since no additional holes in the separation structure are required beyond the holes 53 and 55 for the screws 52 and 54, a maximum amount of integrity of the composite material of the separable structure 10 is maintained. Additional holes for mounting or otherwise assembling a separable structure would further weaken the composite material or other material that the structure is made of. This further weakening is avoided with the severable structure shown in FIG. 1. More holes would also reduce overall airframe stiffness, which would negatively impact guidance control.

It will be appreciated that many alternatives are to the use of screws through holes to couple the separable structure 10 to other structural elements. Examples of other alternatives include V-band clamps, suitable screw threads, taped inserts, and slotted groove interfaces.

Easy separability of the structure 10 is achieved by overlapping the composite material layers 16 and 18 only in the overlap region 20. It will be appreciated that it is advantageous to keep the amount of overlap between the layers 16 and 18 limited, in order to avoid use of additional reactive material 24, to avoid the weight penalty of using additional composite material, and/or to allow clean separation between the composite material structure portions 12 and 14. More broadly, however, it will be appreciated that the structure material 10 may be configured to allow a large range of overlap between portions of the composite material structure portions 12 and 14. It is advantageous that no substantial part of the first composite material structure portion 12 extend to a second attachment region 58 where the second screws 54 are used to couple the separable structure 10 to the second stage 44. Similarly, it is advantageous that no substantial part of the second composite material structure portion 14 extend to a first attachment 56 where the separable structure 10 is coupled to the first stage 42 using the countersunk screws 52. To put it another way, it is advantageous that the separable structure 10 be configured such that substantially no composite material fibers run from the top of the separable structure 10 (where it attaches to the second stage 44) to the bottom of the separable structure 10 (where it attaches to the first stage 42). By having any given composite material fiber run only part way across the separable structure 10, there is no need to sever a substantial number of composite material fibers when separating or severing the separable structure 10 along the separation line 40. To put things yet another way, the second composite material structure portion 14 does not extend into a first side region 62, outside of the overlap region 20, and in a first direction 64 away from the separation line 40. The first composite material structure portion 12 does not extend into a second side region 68, outside of the overlap region 20 and in a second direction 66 away from the separation line 40. The directions 64 and 66 may be substantially opposite from one another.

The composite material may be any of a wide variety of materials using a continuous matrix reinforced by suitable fibers. The matrix material may be any of a wide variety of suitable materials such as thermoset or thermal softening plastics or resins. Examples of suitable resins includes epoxy, cyanate ester (CE), polyimide (PI), and bismaleimide (BMI). The term "resin" is used at times herein to refer generally to such matrix materials. The reinforcing material may be a carbon fiber material. Alternatively, other suitable materials such as suitable polymer fibers or fiberglass may be used.

The reactive material may be any of a wide variety of materials that provide a suitable pyrotechnic reaction when ignited. For example, the reactive material may be gel cast, $Bi_2O_3$/Mg.

Figure 4:
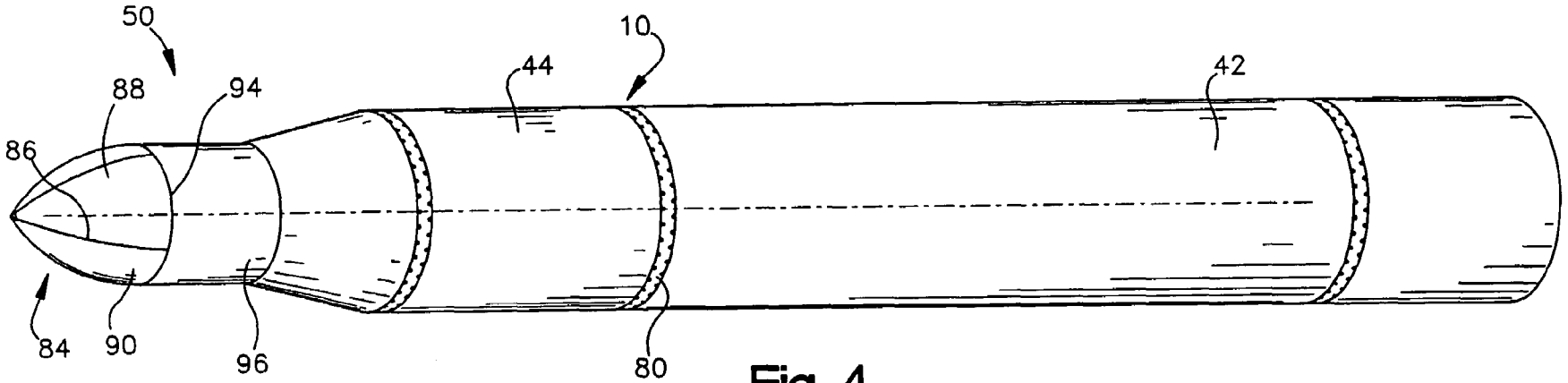
FIG. 4 illustrates a missile that utilizes the structure of FIGS. 1 and 2 at one or more locations.

FIG. 4 shows various locations where the separable structure 10 (or the other separable structure embodiments disclosed herein) may be employed on a missile 50. The separable structure 10 may be employed to separate the first stage 42 from the second stage 44 of the missile 50, along a separation line 80. Alternatively or in addition, the separable structure 10 may be used to separate and jettison parts of a nose cone 84. For example, the separable structure 10 may be used along a separation line 86 between nose cone petals 88 and 90. The separation structure may also be used along a line 94 between the nose cone 84 and a fuselage 96.

The separable structure 10 may be manufactured by building up laminates of layers of the composite material and the reactive pyrotechnic material. The separable structure 10 may include, for example, approximately 30-40 laminates of composite material and reactive pyrotechnic material. The layers of the composite material may have a thickness of about 0.127 mm (5 mils) each, with the separable structure 10 having an overall thickness of about 0.125 to 0.25 inches (3.2 to 6.4 mm). It will be appreciated that structures may have a wide variety of other thicknesses. The illustrations in the figures are not to scale, and with the thickness of the composite material layers increased for clarity of the illustrations, and with the number of layers reduced to simplify the illustrations.

Figure 5:
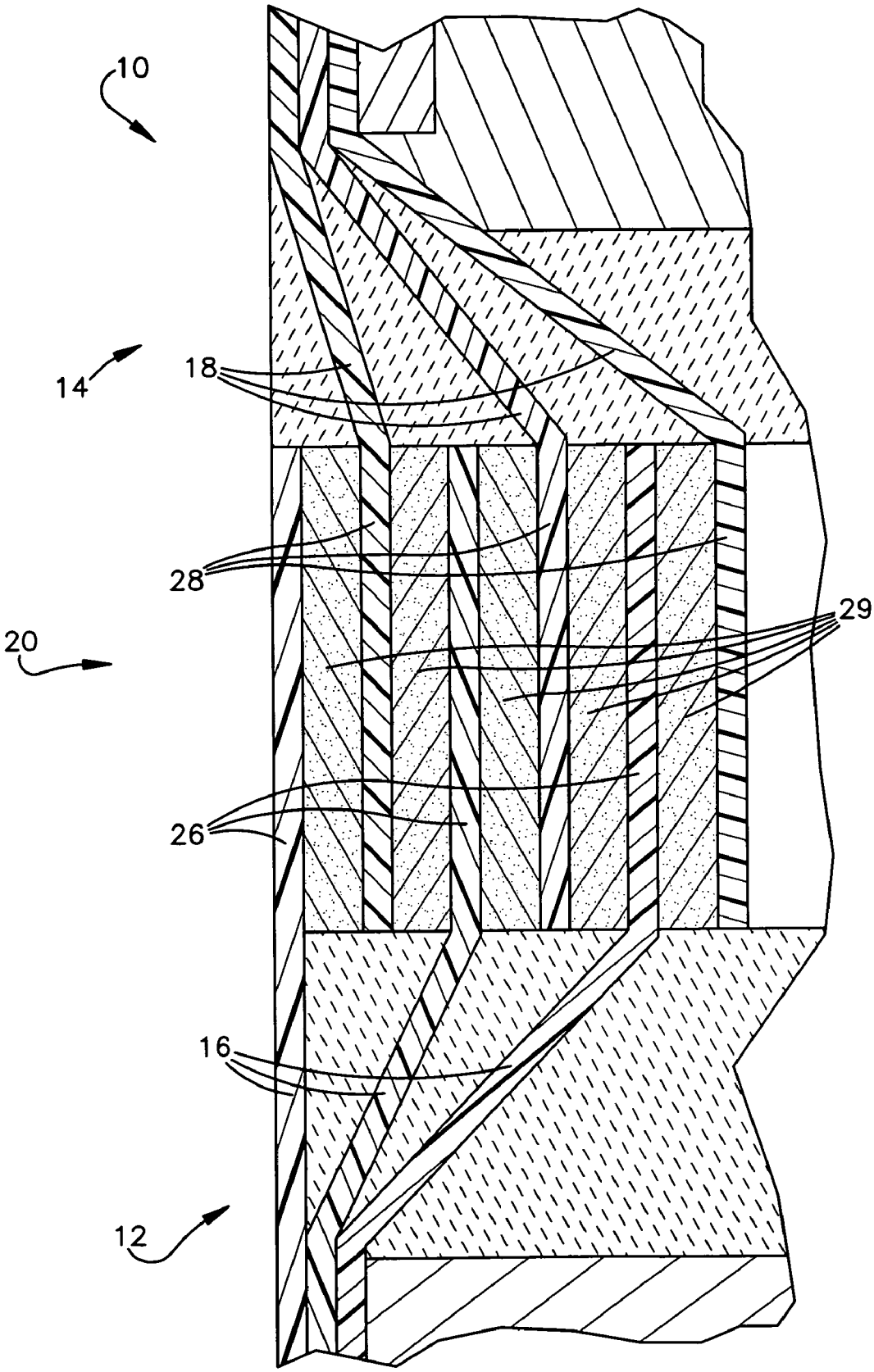
FIG. 5 is a cross-sectional view showing a first alternate embodiment separable structure in accordance with the present invention.

FIG. 5 shows an alternate embodiment of the separable structure 10, having a somewhat different arrangement within the overlap region 20. The embodiment shown in FIG. 5 differs from that shown in FIG. 1 in that it places reactive material layers 29 on both sides (major surfaces) of each of the overlap ends 26 and 28 of the composite material layers 16 or 18. (The embodiment shown in FIG. 1 places the reactive material layers 29 only on one side (major surface) of each of the composite material overlap ends 26 and 28. Thus for the embodiment shown in FIG. 1 only 1 out of every 3 layers is one of the reactive material layers 29.)

The arrangement shown in FIG. 5, with the reactive material layers 29 placed on either side of each of the composite material ends 26 or 28, may allow better performance in separating the composite material structural portions 12 and 14. On the other hand, the arrangement shown in FIG. 1 may allow added strength for the separable material 10.

Figure 6:
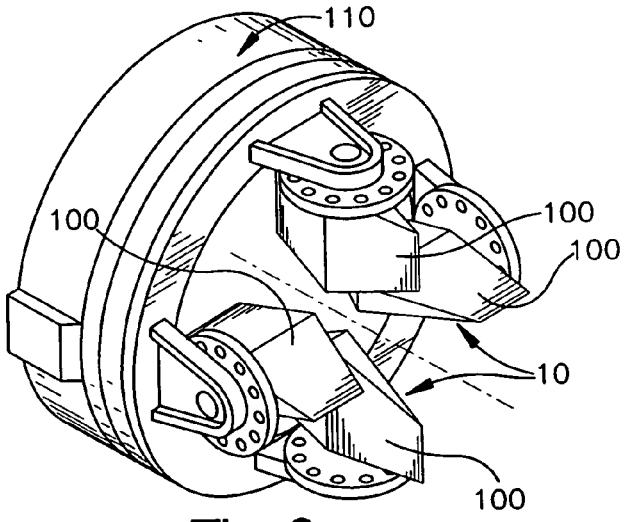
FIG. 6 illustrates another possible use for the separable structures of FIGS. 1 and 2, for severing jet vanes of a missile or rocket engine.

FIG. 6 illustrates another possible use for the separable structure described above, for separating and/or destroying jet vanes that are used to control a missile. A separable structure 10, or other structure embodiments described herein, may be used as all or part of a series of jet vanes 100. The reactive structure may be used to simultaneously sever all of the jet vanes 100. This eliminates the problems that may occur when jet vanes do not separate from a missile at substantially the same time. Presence of some, but not all, of the jet vanes may cause erratic flight of a missile. The severable or separable structure 10 may be placed at any of a variety of suitable locations within or throughout the jet vanes 100. An electrical igniter may be used to simultaneously trigger reactive material in all of the jet vanes 100.

Figure 7:
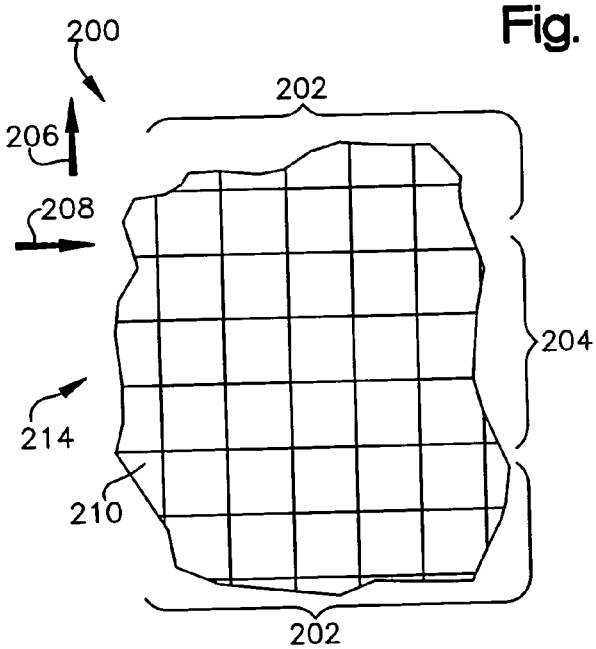
FIG. 7 is a plan view schematically illustrating a layer of separable composite material in accordance with the present invention.

FIG. 7 shows an ignitable composite material 200 that also may be utilized as a destructible or separable material. The composite material 200 includes both load-carrying fibers 202 and reactive material fibers 204. At least some of the load-carrying fibers 202 are oriented along a primary load direction 206. The reactive material fibers 204 (and perhaps some of the load-carrying fibers 202) are oriented in a secondary load direction 208, substantially perpendicular to the primary load direction 206. The fibers 202 and 204 are surrounded by a resin or matrix material 210. The reactive material fibers 204 may be clustered together to form a separation region 214 within the composite material 200. In a manner similar to that described above, the reactive material fibers 204 may be coupled to an electrical igniter, and may be detonated by use of a suitable electrical current. Thus fibers of reactive pyrotechnic material may be placed within a layer of composite material, as a portion of the composite material. The reactive material fibers 204 are preferably placed in an orientation that receives a lesser amount of loading. A composite structure may be formed from plural layers of the composite material 200, with the orientation of the layers being such that reactive material is preferably located away from receiving loads in the primary load direction 206, and such that the reactive material fibers 204 of various of the layers substantially overlap or are in regions where they can cooperatively be used to sever, separate, destroy, or weaken part of a structure.

The load-carrying fibers may be carbon fibers, and the resin 210 may be any of the suitable resins described above. The reactive material fibers 204 may be fibers made from a suitable reactive material, such as those described above.

Figure 8:
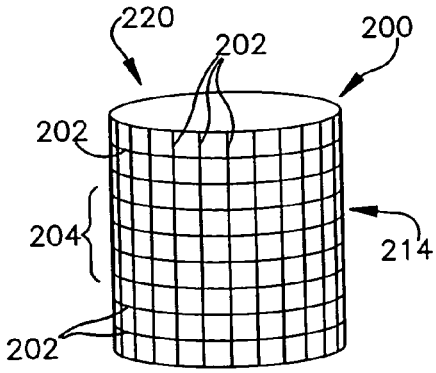
FIG. 8 is an oblique view of one example of a structure made using layers of the material of FIG. 7.

FIG. 8 shows a separable structure 220 composed of plural layers of the composite material 200. The separable structure 220 is cylindrical, and has the reactive material fibers 204 oriented to receive hoop stresses on the structure 220. Often requirements for materials receiving hoop stresses are less demanding than those for axial, tensile or compressive stresses. Thus the reactive material fibers 204 may be capable of meeting requirements for withstanding hoop stresses on the separable structure 220, although the reactive material fibers 204 may be weaker than the load-carrying fibers 202.

Figure 9:
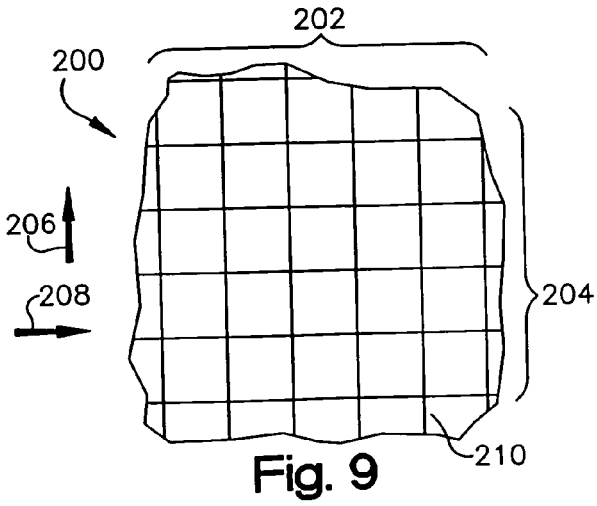
FIG. 9 is a plan view showing another embodiment of the present invention, a disintegratable composite material.

FIG. 9 shows a variation on the ignitable composite material 200 in which all of the fibers in the secondary load direction 208 are reactive material fibers 204. The load-carrying fibers 202 are all placed in a primary load direction 206. It will be appreciated that the material 200 may thus be made fully able to disintegrate, upon ignition of the reactive material fibers 204.

The ignitable composite material 200 has the advantageous property that the reactive material is placed close in contact with the resin 210, and indeed is interspersed throughout the composite material 200. This may make for more efficient severing or destruction of all or a portion of the composite material 200. The actual severing or destruction of the composite material 200 may involve using the reactive material so weaken or break at least some of the load-carrying fibers 202. Alternatively or in addition, it will be appreciated that ignition of the reactive material fibers 204, and the resulting vaporization or destruction of resin material surrounding the reactive material 204, may sufficiently weaken the integrity of the composite material 200 so that loads on the material cause it to disintegrate, break, sever, fall apart, or otherwise structurally fail.

Many variants are possible on the configurations shown in FIGS. 7-9. It may be possible to place reactive material fibers and load-carrying fibers in both primary and secondary load directions, to achieve desired properties of load-carrying and separability or destructability of the resulting material.

What has been described above are a few instances of separable, severable, or disintegratable composite materials. It will be appreciated that such composite materials may be put in any of a wide variety of configurations, for any of a wide variety of uses. Other possible uses include as part of projectile or missile, such as a cruise missile, for separating or destroying parts such as inlet doors, doors for wings, or covers for multiple munitions to be ejected in flight.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A separable laminate structure comprising:

a composite material in plural composite material layers;

a reactive pyrotechnic material placed between layers of the composite material; and an igniter for igniting the reactive pyrotechnic material, to thereby separate parts of the laminate structure along a line of separation;

wherein the composite material includes first and second composite material portions;

wherein the first and second composite material portions include plural first and second continuous composite material layers, respectively;

wherein ends of the first and second composite material layers overlap only in an overlap region;

wherein the first composite material layers extend away from the overlap region in a first direction; and wherein the second composite material layers extend away from the overlap region in a second direction that is different than the first direction.

2. The structure of claim 1, wherein the igniter is an electric igniter.

3. The structure of claim 2, wherein the electric igniter is coupled to at least one wire bridge placed in contact with the reactive material.

4. The structure of claim 1, wherein the line of separation is in the overlap region.

5. The structure of claim 1, wherein the first direction and the second direction are substantially opposite to one another.

6. The structure of claim 1, wherein the reactive material includes a reactive material layer that is in the overlap region, between one of the first composite material layers and between one of the second composite material layers.

7. The structure of claim 6, wherein the reactive material includes additional reactive material layers each between respective of the first composite material layers and the second composite material layers.

8. The structure of claim 7, wherein the structure is part of a stage separation structure of a missile.

9. The structure of claim 7, wherein the structure is part of a missile nose cone.

10. The structure of claim 1, wherein the composite material portions have respective sets of holes therein, outside of the overlap region, for coupling to respective structural elements.

11. The structure of claim 1, wherein the structure is part of a stage separation structure of a missile.

12. The structure of claim 1, wherein the structure is part of a missile nose cone.

13. A separable laminate structure comprising:

a composite material in plural composite material layers;

a reactive pyrotechnic material placed between a pair of the composite material layers; and an igniter for igniting the reactive pyrotechnic material, to thereby separate parts of the laminate structure along a line of separation;

wherein the line of separation is in an overlap region in which the composite material layers overlap;

wherein the reactive pyrotechnic material is configured to separate the composite material layers in the overlap region by reducing integrity of a matrix material of the composite material without severing fibers of the composite material layers;

wherein some of the composite material layers extend beyond the overlap region only on a first side of the line of separation; and wherein other of the composite material layers extend beyond the overlap region only on a second side of the line of separation, opposite the first side.

14. The structure of claim 13, wherein the reactive pyrotechnic material includes reactive laminate layers placed between pairs of the composite material layers.

15. The structure of claim 14, wherein the structure is part of a stage separation structure for a missile.

16. The structure of claim 14, wherein the structure is part of a missile nose cone.

17. The structure of claim 13, wherein the structure is part of a stage separation structure for a missile.

18. The structure of claim 13, wherein the structure is part of a missile nose cone.

19. A separable laminate structure comprising:

a composite material in plural composite material layers;

a reactive pyrotechnic material placed between layers of the composite material; and an igniter for igniting the reactive pyrotechnic material, to thereby separate parts of the laminate structure along a line of separation;

wherein the line of separation is in an overlap region in which ends of the composite material layers overlap; and wherein the structure is part of a stage separation structure of a missile.

20. A separable laminate structure comprising:

a composite material in plural composite material layers;

a reactive pyrotechnic material placed between layers of the composite material; and an igniter for igniting the reactive pyrotechnic material, to thereby separate parts of the laminate structure along a line of separation;

wherein the line of separation is in an overlap region in which ends of the composite material layers overlap; and wherein the structure is part of a missile nose cone.

21. A separable laminate structure comprising:

a composite material in plural composite material layers;

a reactive pyrotechnic material placed between a pair of the composite material layers; and an igniter for igniting the reactive pyrotechnic material, to thereby separate parts of the laminate structure along a line of separation;

wherein the line of separation is in an overlap region in which the composite material layers overlap;

wherein the reactive pyrotechnic material is configured to separate the composite material layers in the overlap region by reducing integrity of a matrix material of the composite material without severing fibers of the composite material layers;

wherein the structure is part of a stage separation structure for a missile.

22. A separable laminate structure comprising:

a composite material in plural composite material layers;

a reactive pyrotechnic material placed between a pair of the composite material layers; and an igniter for igniting the reactive pyrotechnic material, to thereby separate parts of the laminate structure along a line of separation;

wherein the line of separation is in an overlap region in which the composite material layers overlap;

wherein the reactive pyrotechnic material is configured to separate the composite material layers in the overlap region by reducing integrity of a matrix material of the composite material without severing fibers of the composite material layers;

wherein the structure is part of a missile nose cone.

* * * * *